United States Patent [19]

Miller

[11] Patent Number: 5,054,264

[45] Date of Patent: Oct. 8, 1991

[54] EASY TEAR STRAW COVER

[75] Inventor: Cedric C. Miller, 4439 Pembrook Village Dr., Alexandria, Va. 22309

[73] Assignees: Cedric C. Miller; Janice L. Ferguson, Alexandria, Va.

[21] Appl. No.: 626,770

[22] Filed: Dec. 13, 1990

Related U.S. Application Data

[63] Continuation of Ser. No. 560,815, Jul. 31, 1990.

[51] Int. Cl.[5] ..... B65B 61/18

[52] U.S. Cl. ..... 53/412; 53/492

[58] Field of Search ..... 53/133.8, 412, 133.6, 53/492; 83/660; 239/33, 24; 604/16, 263; 206/306, 446, 620, 627; 215/1 A; 229/89.01, 87.05, 87.12, 103.1; 426/85

[56] References Cited

U.S. PATENT DOCUMENTS

| | | | |
|---|---|---|---|
| 1,848,119 | 3/1932 | Fairchild | 53/412 X |
| 2,168,585 | 8/1939 | Schwartz | 206/264 X |
| 2,195,222 | 3/1940 | Neumair | 53/133.6 X |
| 2,280,405 | 4/1942 | Frostad | 53/450 |
| 2,319,448 | 5/1943 | Frostad | 206/443 X |
| 2,584,060 | 1/1952 | Stephano | 53/133.6 X |
| 2,897,087 | 7/1959 | Lawlor | 53/412 X |
| 3,189,171 | 6/1965 | Miller | 239/33 |
| 3,205,750 | 9/1965 | Strange | 83/660 |
| 3,215,265 | 11/1965 | Welin-Berger | 128/736 X |
| 3,445,033 | 5/1969 | Sweet et al. | 239/33 |
| 4,604,852 | 8/1986 | Becker | 53/451 X |
| 4,881,644 | 11/1989 | Norquest et al. | 604/16 X |

*Primary Examiner*—John Sipos
*Assistant Examiner*—Linda B. Johnson
*Attorney, Agent, or Firm*—Walter F. Wessendorf, Jr.

[57] ABSTRACT

A removable straw cover that is sterile in combination with a sterile drinking straw protects the drinking straw against bacterial contamination. A line of circumferential indentations separates the straw cover into a upper proximal portion and a remaining distal portion. Separation along such circumferential line of indentations is effected by grasping closed ends of the straw cover and longitudinally extending the straw cover along its longitudinal axis.

3 Claims, 1 Drawing Sheet

EASY TEAR STRAW COVER

CROSS REFERENCE TO RELATED APPLICATION

This application is a continuation of copending U.S. patent application Ser. No. 07/560,815 filed 07/31/90.

BACKGROUND OF THE INVENTION

1. Technical Field

This invention relates to an easy tear straw cover that encloses, covers and protects a drinking straw against bacterial contamination.

2. Background

A drinking straw is tubular and of elongated open cylindrical configuration. Operationally, a human operator submerges the drinking straw's bottom end or distal end beneath the liquid level in a drinking glass or container, inserts the straw's top end or portion in his mouth, appropriately purses his lips sufficiently to seal around such proximal portion and commences sucking action to create negative mouth pressure to draw the liquid through the straw and into his mouth.

At food and/or drink establishments such as soda fountains, diners, restaurants, bars, etc. drinking straws are in dispensers or containers at central locations, counters, or at individual tables or booths. When a patron selects a drinking straw for his own use, he does not know whether the straw he selected has already been bacterially contaminated by a food and/or drink establishment employee as a result of such employee's handling the straws during "side work" in replenishing dispensers or containers with straws. And, if not thusly contaminated by such employee, prior patrons, in rummaging with their hands through the straws in the dispenser or container, may have bacterially contaminated the straws. Also, a counter employee, waiter or waitress, in using his or her hands to place a straw in a drinking glass, may bacterially contaminate the drinking glass that will be served to the patron.

Hence, there is need for an easily removable straw cover whose sterile interior encloses, covers and protects a sterile drinking straw against bacterial contamination until such time that the cover is removed to allow the sterile drinking straw to be utilized for its intended purpose.

SUMMARY OF THE INVENTION

Accordingly, the object of this invention is to contribute to the solution of the discussed problems of the art by providing an easy tear straw cover whose sterile interior encloses, covers and protects a sterile drinking straw against bacterial contamination. The straw cover can be easily and simply separated into two portions: one portion that covers the upper and proximal portion of the drinking straw and the other that covers the remaining and distal portion of the drinking straw. An employee, in serving a patron a soda or drink, need only manipulatively grasp the closed ends of the straw cover and longitudinally extend the cover to separate the cover into its two portions; remove the portion covering the remaining and distal portion of the exposed straw; submerge the straw's distal end beneath the liquid level of the drinking glass while holding the straw cover's upper proximal portion protecting the straw's upper proximal portion; and then, optionally either remove the straw cover's upper proximal portion or allow the patron himself to remove the straw cover's upper proximal portion.

In an establishment where a patron himself selects a drinking straw from a dispenser or container, such patron, health-wise, will feel and be safe in selecting a sterile drinking straw protected by the straw cover of this invention.

BRIEF DESCRIPTION OF THE DRAWINGS

This object and other objects of the invention should be discerned and appreciated from the detailed description of the preferred embodiment taken in conjunction with the drawings, wherein like reference numerals refer to similar parts throughout the several drawing figures, in which.

DETAILED DESCRIPTION OF THE PREFERRED EMBODIMENT

Figure 1:
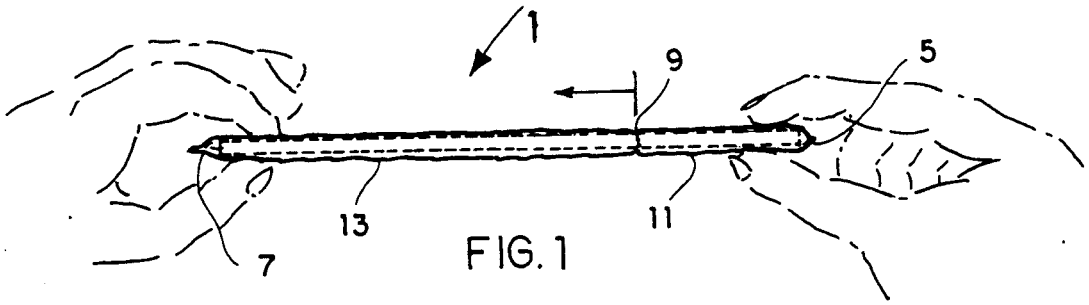
FIG. 1 is a view of the straw cover preparatory to its manipulative separation for its removal to expose the drinking straw.
Figure 2:
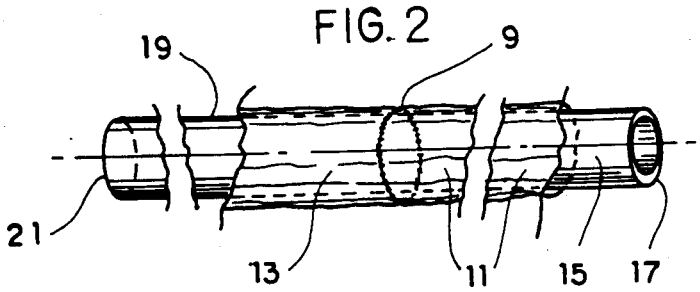
FIG. 2 is a view of part of the straw cover covering the drinking straw.
Figure 3:
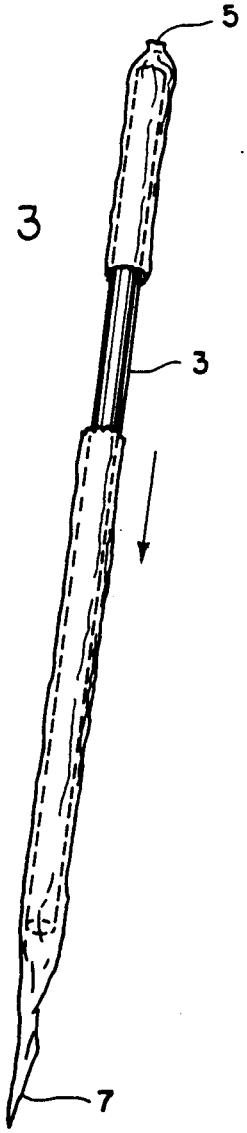
FIG. 3 shows the straw cover separated into its two portions along its weakened circumferential line of indentations.
Figure 4:
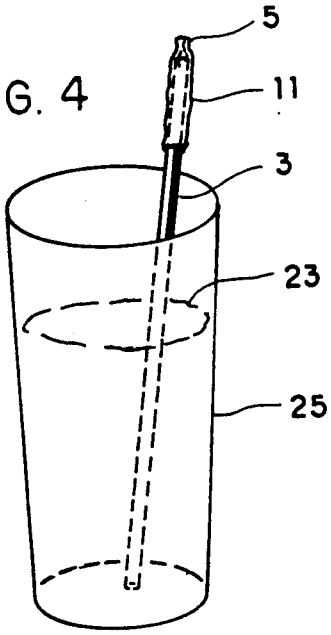
FIG. 4 shows the exposed distal portion of the drinking straw submerged beneath the liquid level in a drinking glass, and with the proximal portion of the drinking straw covered and protected by the proximal portion of the straw cover.

In FIG. 1 of the drawings, reference numeral 1 generally refers to the invention of the straw cover. Cover 1 is made of paper or other suitable material and encloses a drinking straw 3 made of paper or other suitable material. Straw cover 1 has a closed proximal end 5 and a closed distal end 7. The interior of straw cover 1 is sterile and drinking straw 3 is likewise sterile. Straw cover 1 encloses, covers and protects drinking straw 3 against bacterial contamination. Straw cover 1 has a circumferential line of indentations 9, weakened by a fine milled stamp with dull beveled joints or other suitable pressure sensitive application, such that, upon a human operator's manipulatively grasping appropriately the closed ends 5 and 7 of the straw cover 1, and longitudinally extending straw cover 1 sufficiently, the straw cover 1 will separate along the circumferential line of indentations 9 into two portions, to wit: an upper proximal portion 11 and a remaining distal portion 13. The upper proximal portion 11 of straw cover 1 covers the upper proximal portion 15 and proximal end 17 of drinking straw 3, while the remaining distal portion 13 of straw cover 1 covers the remaining distal portion 19 and distal end 21 of drinking straw 3. Drinking straw 3 is tubular and of elongated open cylindrical configuration.

After straw cover 1 has been separated thusly along its circumferential line of indentation 9, the remaining distal portion 13 of straw cover 1 is removed, the distal end 21 of drinking straw 3 is submerged beneath the level of the liquid 23 in the drinking glass 25, and then the human operator can either remove the upper proximal portion 11 of straw cover 1 from the drinking straw 3 or wait until he is ready to sip liquid 23 from glass 25 before he removes upper proximal portion 11 of straw cover 1.

What is claimed is:

1. The method of using a sterile drinking straw having a distal portion with an open distal end and a proximal portion with an open proximal end, said sterile drinking straw being enclosed, covered, protected and sealed against bacterial contamination by a straw cover whose interior is sterile, said straw cover being weakened by a circumferential line of non-perforating indentations defining distal and proximal portions of said straw cover, said distal portion of said straw cover having a distal end and said proximal portion of said straw cover having a proximal end, said distal and proximal ends of said straw cover sealing said drinking straw against bacterial contamination, said method of use comprising the steps of:

manipulative grasping by a human operator of said distal and proximal ends of said straw cover;

longitudinally extending 'sufficiently said straw cover, while said distal and proximal ends of said straw cover remain grasped, to separate said straw cover into its said distal and proximal portions along its said circumferential line of indentations;

manipulatively removing said distal portion of said straw cover to expose said distal portion of said drinking straw and its said distal end, while leaving said proximal portion of said straw cover intact with said straw cover's proximal portion and end still covering and sealing, against bacterial contamination, said proximal portion and end of said drinking straw;

submerging said exposed distal end of said drinking straw beneath the liquid level of liquid in a container; and manipulatively removing said proximal portion of said straw cover to expose said proximal portion and end of said drinking straw, preparatory to the human operator's draw-liquid from the container through said distal end of said drinking straw to and through its said proximal end.

2. The method of claim 1 wherein the material of choice for said straw cover is paper.

3. The method of claim 1 wherein said drinking straw is tubular and is of elongated open cylindrical configuration.

* * * * *